US005425446A

United States Patent [19]

Weaver et al.

[11] Patent Number: 5,425,446

[45] Date of Patent: Jun. 20, 1995

[54] CONTAINER PACKAGE WITH COMPOSITE CARRIER

[75] Inventors: William N. Weaver, Northbrook; Michael A. Binsfeld, Chicago, both of Ill.

[73] Assignee: Illinois Tool Works Inc., Glenview, Ill.

[21] Appl. No.: 300,589

[22] Filed: Sep. 2, 1994

Related U.S. Application Data

[63] Continuation of Ser. No. 109,380, Aug. 19, 1993, abandoned.

[51] Int. Cl.[6] ..... B65B 75/00

[52] U.S. Cl. ..... 206/145; 206/427

[58] Field of Search ..... 206/139, 141, 144, 145, 206/147, 148, 149, 150, 151, 152, 154, 158, 161, 153, 427

[56] References Cited

U.S. PATENT DOCUMENTS 3,311,402 3/1967 Spandock ..... 206/153 X
3,700,275 10/1972 Deasy ..... 206/196 X
3,923,155 12/1975 Tanzer ..... 206/141 X
4,807,751 2/1989 Klygis et al. .
4,880,115 11/1989 Chaussadas ..... 206/139 X
4,974,726 12/1990 Klygis et al. ..... 206/150 X
5,230,425 7/1993 Edqvist et al. ..... 206/147 X

*Primary Examiner*—Jacob K. Ackun
*Attorney, Agent, or Firm*—Trexler, Bushnell, Giangiorgi & Blackstone, Ltd.

[57] ABSTRACT

A can package is disclosed, including an array of cans disposed in longitudinal rows and transverse ranks. A first carrier member of resilient, flexible, plastic material includes a similar array of apertures respectively receiving can bodies. A second carrier member of self-supporting sheet material or paperboard includes a top panel overlying chimes of the cans and opposite side panels extending down along opposite sides of the cans and secured to the plastic carrier member. Slits are formed in the second member at junctions between the top panel and the side panels for presenting opposing edges respectively extending over and engaging beneath chimes of adjacent cans.

15 Claims, 2 Drawing Sheets

CONTAINER PACKAGE WITH COMPOSITE CARRIER

This application is a continuation of application Ser. No. 08/109,380, filed Aug. 19, 1993, and now abandoned.

BACKGROUND OF THE INVENTION

The present invention relates to a novel package, including a carrier and a plurality of containers, and more particularly to a novel unitary package for an array of containers, such as cans.

Packages of cans, such as conventional six-packs or twelve-packs, have become well-known. One type of package utilizes a carrier made from a thin sheet of resilient, flexible plastic material, having apertures therein which receive and grip the cans. Another type of well-known carrier utilizes a paperboard sheet which is wrapped around the cans. Advantages of the aforementioned plastic sheet carriers include economy of production and assembly with the cans, but such carriers provide no space for the printing of trademarks, advertising material, and the like. Advantages of the paperboard type carriers include the enclosing of the cans and the provision of panels for receiving the printing of promotional or advertising material. However, many such heretofore proposed paperboard carriers are relatively expensive.

SUMMARY OF THE INVENTION

It is an important object to the present invention to provide a novel container package which is both economical and constructed so that it may be utilized for displaying promotional or advertising material.

A more specific object of the present invention is to provide a novel can package, including a composite carrier comprising an economical plastic member and also a relatively inexpensive sheet member of paperboard and the like, which may be economically fabricated and assembled for securely retaining the cans in the package and, at the same time, enabling the package to display advertising or promotional material.

Other objects and advantages of the present invention will become apparent from the detailed description given below and the accompanying drawings.

A package incorporating features of the present invention includes an array of containers, such as cans, arranged in longitudinal rows and transverse ranks. For example, conventional beverage cans may be used, which cans include a cylindrical body, an upper end having an end seam or chime and a tapered or frustoconical section between the chime and the cylindrical body. A first carrier member constructed of resilient, flexible plastic material, and having an array of can body receiving apertures, is assembled around the cylindrical body portions of the cans. A second carrier member formed from paperboard or other suitable self-supporting sheet material is assembled over the top and opposite sides of the array of cans, and is secured to the first member. The second carrier member has a top panel overlying the chimes of the cans and depending opposite side panels. Discreet spaced-apart slits are formed between the top panel and the side panels. The slits are constructed so as to present edges conforming generally to the configuration of the chimes and disposed when engaging beneath the chimes for supporting the cans in the package. Handle means is preferably provided in the top panel for facilitating carrying of the package, and the side panels are sufficiently broad to present surfaces for receiving advertising or promotional material.

DETAILED DESCRIPTION OF A PREFERRED EMBODIMENT

Figure 1:
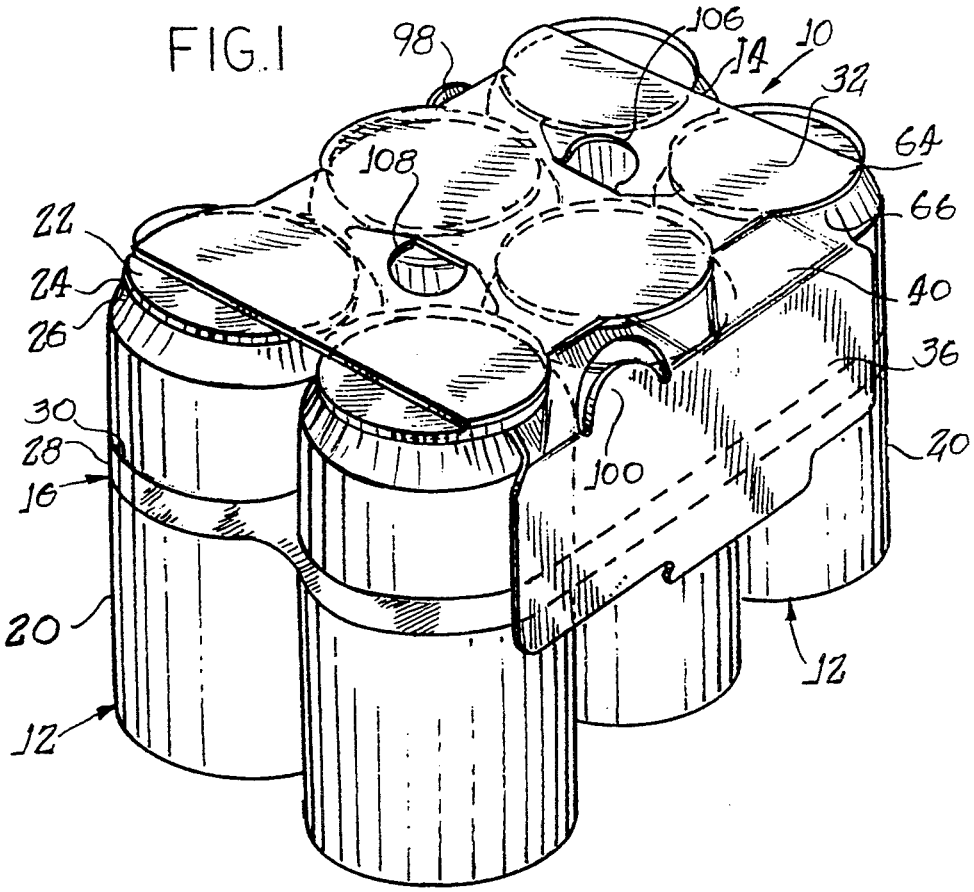
FIG. 1 is a perspective view showing a container package incorporating features of the present invention.
Figure 2:
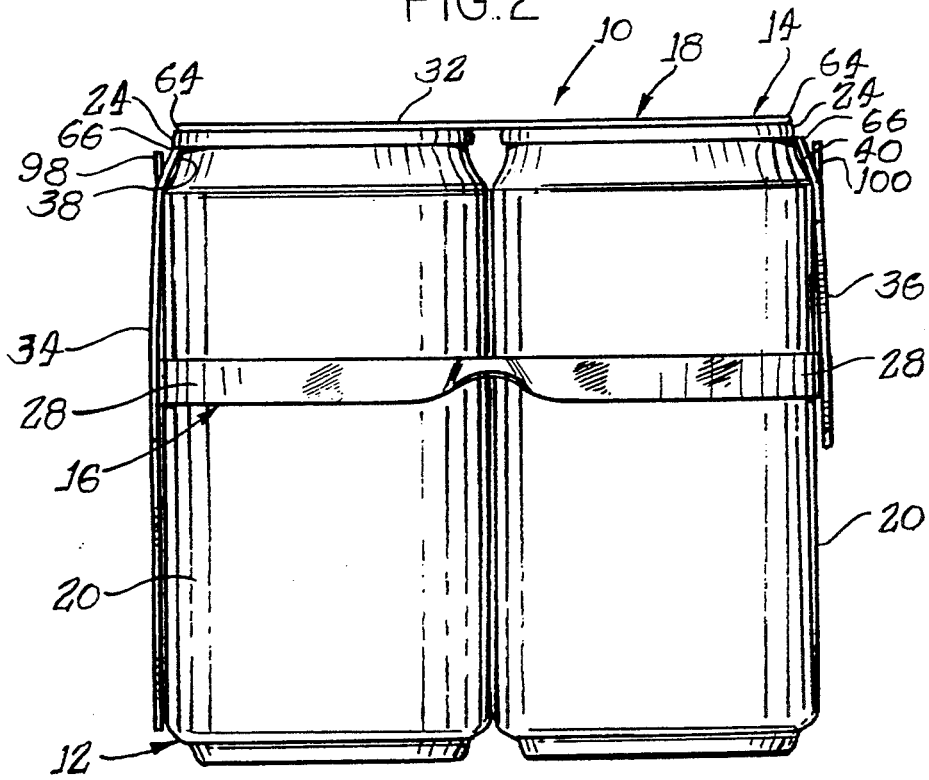
FIG. 2 is an end view of the package shown in FIG. 1.
Figure 3:
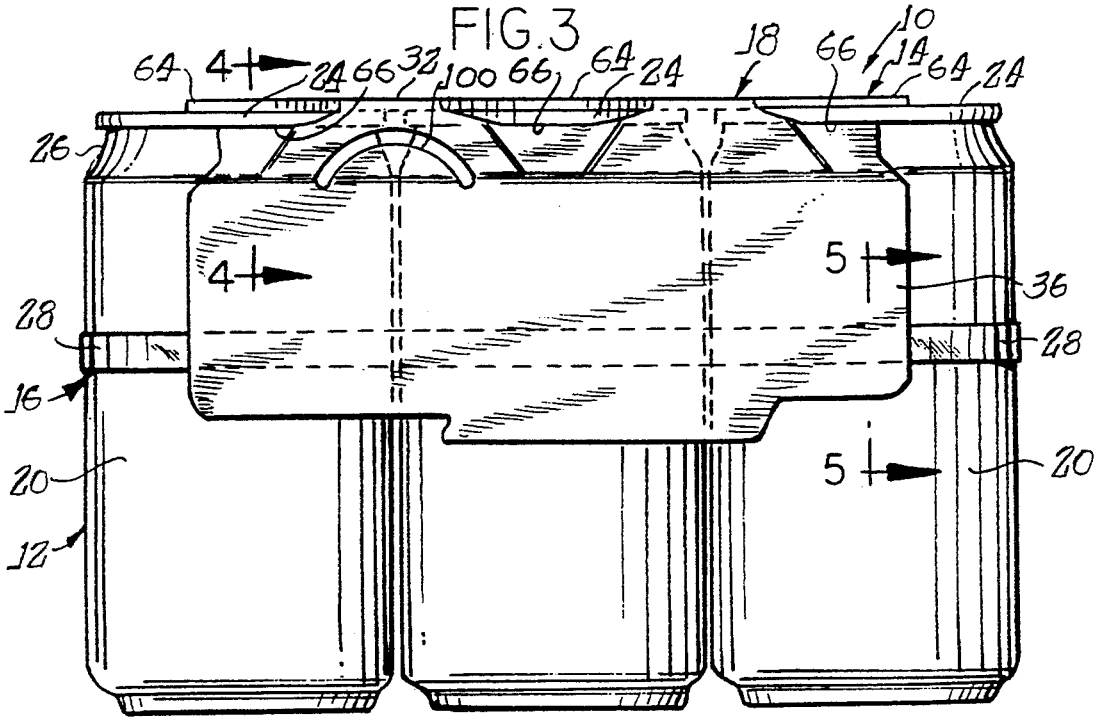
FIG. 3 is a side elevational view of the package shown in FIG. 1.

Referring now more specifically to the drawings, wherein like parts are designated by the same numerals throughout the various figures, a package 10, incorporating features of the present invention, is shown in FIGS. 1, 2, and 3. The package 10 comprises a plurality of cans 12 disposed in an array with a plurality of cans in longitudinal rows, and also a plurality of cans in transverse ranks. The cans 12 are retained in the package by a carrier 14, which carrier comprises a first carrier member 16 interconnected with a second carrier member 18 constructed and arranged in a manner to be described below.

The containers or cans 10 may be of any well-known construction and include a cylindrical main body 20 connected to an upper end or top member 22 by a conventional end seam or chime 24. The cylindrical body 20 has a first diameter, while the upper end, and thus, the chime 24, have a second smaller diameter. A tapering or frustoconical annular section 26 joins the main cylindrical can body 20 with the chime 24. As will be understood, the tapering or frustoconical section 26 may have a smooth wall or may be stepped in a known manner.

The carrier member 16 is formed from a thin sheet of resilient, flexible polymeric material, such as low density polyethylene, The carrier 16 may be of any known construction, such as that disclosed in U.S. Pat. Nos. 2,874,835, 4,018,331, and 4,219,117. It suffices to state here that the carrier 16 has an array of interconnected resilient bands 28 defining apertures 30, having a diameter initially slightly less than the diameter of the can bodies 20. The carrier 16 is assembled with the cans so that the bands 28 engage the bodies 20 any desired distance below the frustoconical section 26. When this is done, bands 28 are stretched and serve to resiliently grip and retain the cans in the package.

Figure 6:
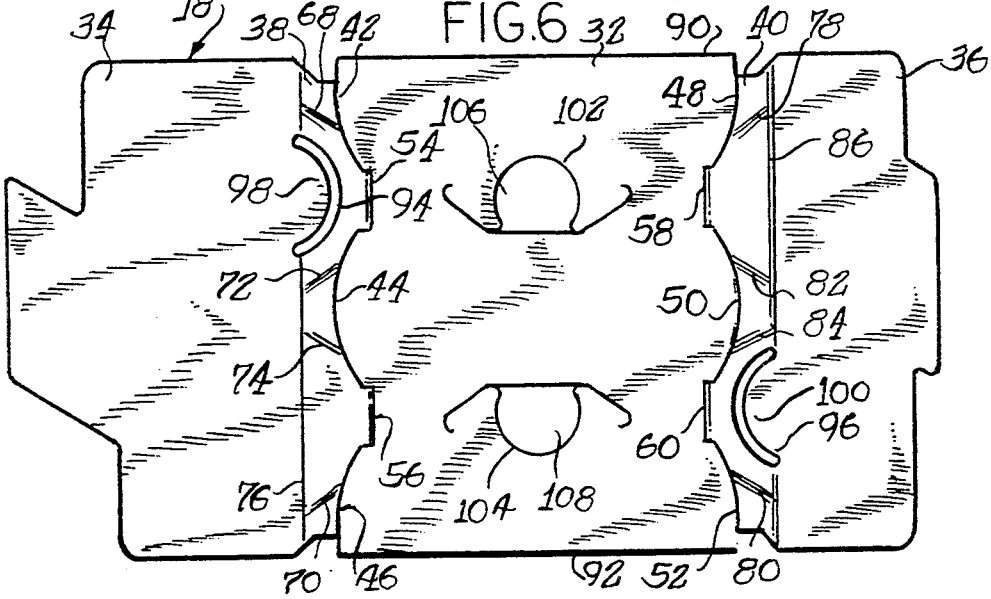
FIG. 6 is a plan view of a blank used to form one part of the carrier member of the present invention.

The second carrier member 18 of the carrier 14 is formed from a blank of sheet material shown in FIG. 6. The blank for the member 18 comprises a planar sheet of paperboard, or pointboard, or any other suitable substantially self-supporting sheet material, which may, for example, be a filled or unfilled polymeric material.

The blank of the carrier member is slit and scored, as shown in FIG. 6, and as will be described in more detail below, so as to define a central or top panel 32, opposite side panels 34 and 36, and relatively short intermediate side sections 38 and 40 between the top panel and the side panels. More specifically, discreet arcuate slits 42, 44, and 46 are provided at the margin or junction of the top panel and the intermediate side section 38, and similar discreet spaced-apart slits 48, 50, and 52 are provided between an opposite margin of the top panel and the opposite intermediate side section 40. The side section 38 remains integrally joined to the top panel 32 at scored bend lines 54 and 56, and the intermediate side section 40 similarly remains integrally joined to the top panel at scored bend lines 58 and 60, respectively, between adjacent discreet slits.

Figure 7:
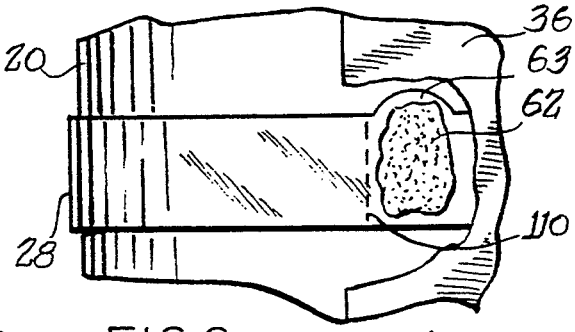
FIG. 7 is an enlarged fragmentary side elevational view partially broken away showing a slightly modified form of the present invention.
Figure 5:
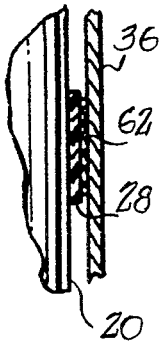
FIG. 5 is an enlarged fragmentary partial sectional view taken along line 5—5 in FIG. 3.

When the carrier member 18 is assembled in the package, as shown in FIGS. 1, 2, and 3, it is seen that the top panel 32 remains substantially flat and lies flush against the upper edges of the chimes 24. The side panels 34 depend along the opposite sides of the array of cans and overlap the carrier member 16. The side panels 34 and 36 are connected to the bands of the carrier 16 by any suitable means. Preferably, this connection is made by providing a spot of adhesive 62 between the side panels and the bands 28, as shown in FIGS. 5 and 7, or the adhesive may be connected by selectively fusing the bands to the carrier member. Also, as shown in FIG. 7, the region of the band that is to receive the adhesive 62 may be modified to be slightly wider at 63 than other regions to provide a larger area to receive the adhesive applied by highly automated high-speed equipment. Adhesives suitable for connecting the paperboard carrier member 18 to the plastic carrier member 16 are well-known. The adhesive may be on each band, or may be on less than all bands on each side of the package.

When the side panels 34 and 36 are folded down along the sides of the cans, the intermediate inclined side sections 38 and 40 will be folded downwardly also, and these sections are constructed so as to incline to generally conform to the inclined configuration of the frustoconical sections 26 of the cans. As shown in the drawings, and particularly FIGS. 3 and 4, the slits 42–46 and 48–52 are defined by opposed edges 64 and 66, respectively, on the top panel and the side sections or panels 38 and 40. As shown in FIG. 6, the slits 42–46 and 48–52 are of arcuate configuration and conform generally to the arc of the circular chimes 24. Thus, the edges 64 and 66 also conform generally to the arc of the chimes.

Figure 4:
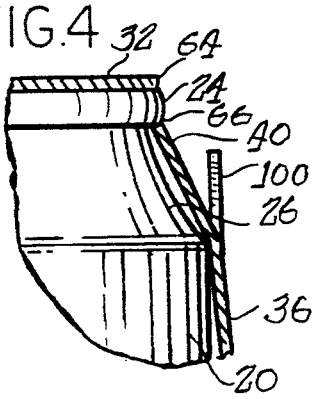
FIG. 4 is an enlarged fragmentary partial sectional view taken along line 4—4 in FIG. 3.

When the carrier member 18 is fully assembled, the arcuate edges 64 overlie and conform with the top edges of the chimes 24, while the opposing arcuate edges 66 underlie and engage beneath the chimes, as shown best in FIG. 4, for providing a positive interconnection between the carrier member 18 and the cans. Thus, the cans are retained both by the resilient gripping action of the carrier member 16 and by the positive interconnection with the member 18, and since these two members are connected together, they combine to provide a secure package.

As discussed above, when the carrier member 18 is applied to the cans, the intermediate sections 38 and 40 tend to conform with the frustoconical end portions 26 of the cans. In order to promote such forming of the carrier member around the cans, inclined scored bend lines 68 and 70 are defined in the intermediate section 38 in association with the slits 42 and 46, respectively, and a similar pair of scored oppositely diverging bend lines 72 and 74 is formed in the section 38 in association with the slit 44. It will be observed that these bend lines 68 through 74, respectively, extend from points adjacent center lines of the cans and around such adjacent cans for promoting proper bending of the sheet material of the carrier member 18. Preferably, lower ends of the bend lines 68 through 74 terminate at a horizontally scored bend line 76, which defines the junction between the side panel 34 and the intermediate panel 38. The intermediate side panel 40 is provided with scored bend lines 78, 80, 82, and 84 extending from a junction or scored bend line 86 with the side panel 36 in the same manner as, and for the same purpose as, the above-discussed inclined bend lines 68 through 74.

As shown in FIGS. 1 and 2, the width of the top panel 32, as defined by the marginal edges 64 provided by the slits 42, 44, 46, 48, 50, and 52, as shown in FIG. 6, corresponds to the width of the array defined by the chimes 24 of the cans. Thus, the side marginal edges 64 of the top panel substantially completely overlie the chimes 24 in the transverse direction. It is also to be noted that, as shown in FIGS. 1 and 3, the length of the top panel 32 is such that opposite ends 90 and 92 of the top panel extend beyond center lines of the opposite end cans in the array. Thus, the top panel 32 substantially covers the upper ends of the cans and provides a well-supported, flat base on which another package can be stacked, if desired. The broad, flat top panel 32 also provides substantial space on which advertising or promotional material may be printed.

If desired, the side panels 34 and 36 could be extended so as to extend for substantially the full height of the can bodies. However, these side panels can also be cut off at any desired point below the carrier member 16 in order to save material and costs, if desired. In any event, since the side panels 34 and 36 extend for a substantial distance along the sides of the cans, they provide space for the printing of promotional and advertising materials. It is further to be noted that the side panels 34 and 36 have portions that do extend below the carrier member 16, and these portions can be cut to various and even different configurations to satisfy various promotional needs.

Referring particularly to FIGS. 3, 4, and 6, it is seen that slits or slots 94 and 96 can be provided in one or both of the intermediate side sections 38 and 40 for defining segments or tabs 98 and 100. In addition, the scored bend lines 76 and 86 are formed so that they do not intersect the tabs or segments 98 and 100. With this arrangement, when the carrier member 18 is applied to the cans, the tabs 98 and 100 will remain in the plane of their respective side panels 34 and 36 for the purpose of providing a three-dimensional display, as indicated in FIGS. 1 and 4.

In order to facilitate manual handling of the package, the top panel 34 is preferably provided with handle means. This handle means is in the form of slits 102 and 104, defining tabs 106 and 108, which may be manually pushed inwardly to provide finger holes for a user. Alternatively, a handle could be integrally formed with the carrier and extend from either end of the package.

In FIG. 7, there is shown a slightly modified form of the present invention. In this embodiment, a perforated or otherwise weakened tear line 110 is provided through the bands 28 of the carrier member 16 at positions adjacent the adhesive 62 or other means provided for securing the bands to the side walls of the carrier. With this feature, when a user tears the paperboard side wall 36 from the package in order to remove the containers, the portion of the bands 28 secured to the paperboard by the adhesive or securing means 62 will be removed with the paperboard and the bands 28 will tear along the weakened lines 110, so that the cans are automatically released from the package.

While a preferred embodiment of the present invention has been shown and described herein, many structural details may be changed without departing from the spirit and scope of the appended claims. For example, the glue spots 62 could be applied to only one or two rather than all three of the bands at opposite sides of the package, or the side panels could be shaped or reduced so as to present relatively small tabs to which the glue is applied.

The invention is claimed as follows:

1. A package comprising an array of containers arranged in longitudinal rows and transverse ranks, said containers having cylindrical bodies and annular upper end chimes, a first carrier member of resilient, flexible, plastic material having a plurality of constrictive apertures respectively receiving and retaining said bodies at a location substantially below said chimes, a second sheet material member, including a top panel transversely overlying adjacent container chimes, said second member further including side panels extending downwardly from opposite side margins of said top panel along sides of said bodies and substantially engaging portions of said first member, means for securing said side panels to said first member portions, said top panel having a plurality of discreet curved slits solely along the outer margins of said top panel defining opposing, curved, marginal edge portions of said top panel, said side panels having curved edge portions along the upper margins of said side panels which substantially conform to the annular shape of said chimes, and said curved edge portions of said side panels engaging said chimes in opposing relationship to said curved edge portions of said top panel substantially fully between the opposite ends of the slits for supporting the containers when the package is carried by said second member.

2. A package, as defined in claim 1, wherein said second member includes hand-engageable means for facilitating carrying of the package.

3. A package, as defined in claim 1, wherein said side panels include wide planar portions adapted for receiving decorative or advertising printing.

4. A package, as defined in claim 1, wherein said containers are cans including a generally frustoconical portion between said chimes and the cylindrical bodies, and said side panels include sections inclined for overlaying and conforming to said frustoconical portions.

5. A package, as defined in claim 4, wherein at least one of said inclined portions is interrupted for defining a segment thereof which projects outwardly for presenting a three-dimensional display on the package.

6. A package, as defined in claim 5, wherein said outwardly projecting segment is located between adjacent containers.

7. A package, as defined in claim 1, wherein the means for securing the side panels to the first member is an adhesive bond.

8. A package, as defined in claim 7, wherein the adhesive is a discrete adhesive material interposed between at least one band of the first member and the side panel.

9. A package comprising an array of cans disposed in rows and ranks, each containing a plurality of cans, each of said cans including a cylindrical body of predetermined diameter, an annular upper end chime of smaller diameter, and a frustoconical section joining the body and the chime, a first resilient, flexible, plastic carrier member having a plurality of apertures each respectively receiving and gripping a container body below said frustoconical section, a second self-supporting sheet material member having a top panel transversely overlying adjacent chimes, said second member including opposite side panels disposed along said can bodies at opposite sides of said array of cans, means for connecting said side panels to said first member, said second member including inclined sections respectively between opposite margins of said top panel and said side panels for overlaying and conforming substantially to said frustoconical sections of the cans, and discreet, spaced-apart, curved slits solely at said opposite margins of the top panel and defined by opposed edges respectively on said top panel and said inclined sections, said curved slits substantially conforming to the annular shape of said chimes, said edges on said inclined sections respectively engaging beneath a chime of an adjacent can.

10. A package, as defined in claim 9, which includes means for defining finger holes in said top panel for facilitating carrying of the package.

11. A package, as defined in claim 9, wherein said slits are arcuate and said edges substantially conform to said chime.

12. A package, as defined in claim 9, wherein said top panel is substantially flat and has opposite end edges located outwardly of centers of opposite end cans in each of said rows, said top panel being supported by said chimes for providing a stable base for the stacking of a plurality of said packages.

13. A package, as defined in claim 12, wherein said chimes define circles, and said arcuate edges on said top panel substantially completely cover the chimes.

14. A package, as defined in claim 9, wherein the carrier member includes means for weakening said carrier member adjacent the connecting means to permit the removal of the sheet material to break the carrier member.

15. A package comprising an array of containers arranged in longitudinal rows and transverse ranks, said containers having cylindrical bodies, annular upper end chimes, and a generally frustoconical portion between said chimes and the cylindrical bodies, a first carrier member of resilient, flexible, plastic material having a plurality of constrictive apertures respectively receiving and retaining said bodies at a location substantially below said chimes, a second sheet material member, including a top panel overlying said chimes, said second member further including side panels extending downwardly from opposite side margins of said top panel along sides of said bodies and substantially engaging portions of said first member, said second member including sections inclined for overlaying and conforming to said frustoconical portions, at least one of said inclined sections being interrupted for defining a segment thereof which projects outwardly from said inclined section for presenting a three-dimensional display on the package, said segment lying in substantially the same plane as the side panel, means for securing said side panels to said first member, said second member having a plurality of discreet slits therein defining opposing edge portions of said top panel and said inclined sections, said edge portions of said top panel overlying adjacent container chimes, and said edge portions of said side engaging said adjacent chimes in opposing relationship to said top panel edges for supporting the containers when the package is carried by said second member.

* * * * *